United States Patent [19]

Mayer et al.

[11] 4,312,141

[45] Jan. 26, 1982

[54] CROSS COUNTRY SKIING BOOT FITTING INTO A DEVICE FOR THE LATERAL GUIDANCE THEREOF OF THE SKI

[75] Inventors: Hubert Mayer, Marly; Ernst Praudisch, Möhlin, both of Switzerland

[73] Assignee: Bata Schuh AG, Mohlin, Switzerland

[21] Appl. No.: 196,911

[22] PCT Filed: Dec. 13, 1978

[86] PCT No.: PCT/CH78/00051

§ 371 Date: May 5, 1980

§ 102(e) Date: Feb. 14, 1980

[30] Foreign Application Priority Data

Sep. 5, 1978 [CH] Switzerland ..... 9302/78

[51] Int. Cl.[3] ..... A43B 5/04; A63C 9/00

[52] U.S. Cl. ..... 36/117; 280/615

[58] Field of Search ..... 36/117, 118, 119, 120, 36/121; 280/615, 614, 607, 636

[56] References Cited

U.S. PATENT DOCUMENTS 4,082,312 4/1978 Johnson ..... 36/117

FOREIGN PATENT DOCUMENTS 2338719 8/1977 France ..... 36/117

2345181 10/1977 France ..... 36/117

396278 12/1976 Switzerland ..... 36/117

*Primary Examiner*—Patrick D. Lawson

*Attorney, Agent, or Firm*—Weingarten, Schurgin & Gagnebin

[57] ABSTRACT

The cross country skiing boot fitting into a device carrying a plate (8) with preferably one, two or more parallel longitudinal ribs (9) has corresponding parallel depressions (10) in the sole (5). These ribs engage in the depressions and provide lateral guidance for the long distance skiing boot, specifically during descents. The relative movement of the boot (3) with respect to the ski (1) is not impeded during cross country skiing, neither special engagement nor disengagement being unnecessary.

5 Claims, 3 Drawing Figures

Figure 1:
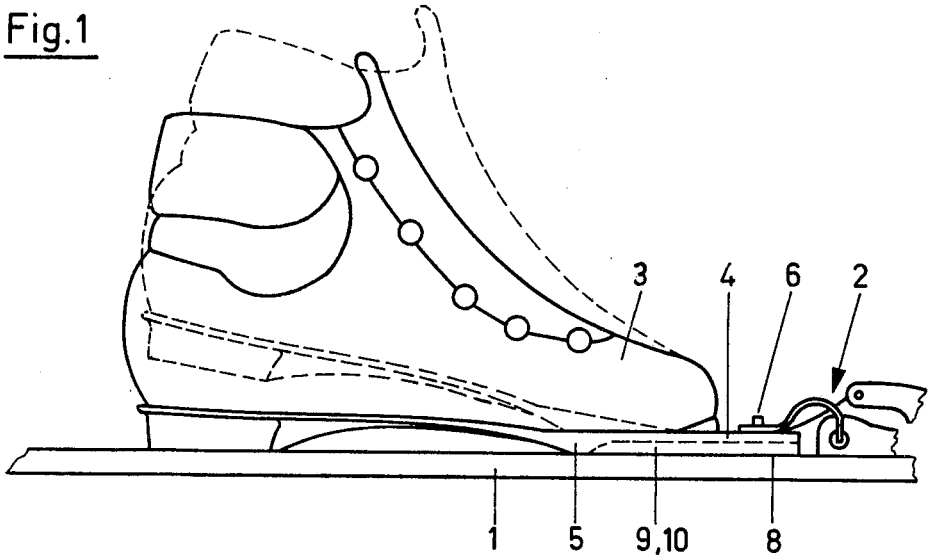

CROSS COUNTRY SKIING BOOT FITTING INTO A DEVICE FOR THE LATERAL GUIDANCE THEREOF OF THE SKI

The invention relates to a cross country skiing boot and which is fitted into a device for the lateral guidance thereof on the corresponding ski.

The connection between a cross-country skiing boot and the actual ski must satisfy two opposing conditions. When skiing on a level or rising slope the boot must have a sufficient freedom of movement in a substantially vertical plane and may only be connected to the ski to such an extent that it can move the ski forwards. Most of the known ski bindings located at the front of the boot have long satisfied this requirement. However, if the skier enters a descent, possibly with bends best passed through with normal skis, a rigid connection between boot and ski would be preferable because for passing through the said bends it is necessary to transmit powerful lateral forces. It is known that most cross country ski bindings are unsatisfactory for this purpose, so that such descents become a problem.

Various solutions have been proposed such as e.g. several types of bindings which fix not only the front of the boot but also the back for descent purposes. At the end of the descent said binding is disengaged and the boot can again move freely up and down. However, at the start and finish of the descent the connection between boot and ski must be engaged or disengaged. However, if there are a number of short descents and short ascents or flat intermediate sections the constant engaging and disengaging becomes irksome and, if there are many skiers on the slope it also annoys following skiers.

The present invention is directed at providing a cross country skiing boot with effective lateral guidance on the ski and which functions without any actuation on the part of the skier. The invention is based on the fact that during descent the boot generally rests on the ski with at least the complete front part of the sole, whereas in the case of the skiing movement this is only the case when the forward movement of one ski is ended and the other ski is moved forwards.

According to the invention this cross country skiing boot is characterized by the features of claims 1 to 5.

Thus, a reciprocal enchoring is obtained between ski and boot, specifically when the latter rests flat on the ski, which is able to transmit relatively large lateral forces. As a result it is possible to pass through descents without involving the hitherto encountered danger that during swinging or stemming the boot can be inclined relative to the ski to such an extent that it finally slips down from the ski by the heel.

In principle random methods can be used for obtaining the elevation and depression referred to in claim 1. However, it has proved advantageous to provide one, two or more parallel depressions in the sole of the boot. This is simple from the manufacturing standpoint and also provides a large surface area for absorbing the lateral pressures and consequently a relatively small surface pressure.

There is no need for the depressions or elevations to extend over the entire length of the boot, although in principle it would be advantageous if the heel of the boot could also transmit forces. However, it is sufficient if the device is provided only over the length of the front part of the sole.

Figure 2:
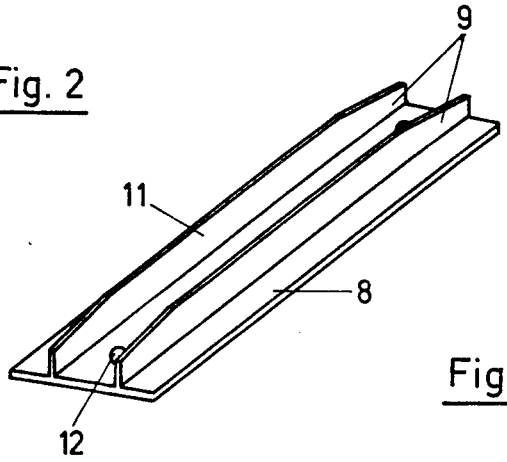
Figure 3:
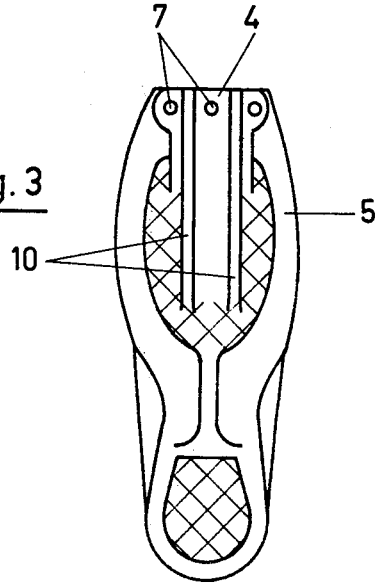

An embodiment of the cross country skiing boot is described hereinafrer relative to the drawings, wherein show:

FIG. 1, a side view of the cross country skiing boot, its fixing, guidance device and the ski;

FIG. 2, a perspective view of the part of the device on the ski which forms the elevation;

FIG. 3, a view from below of the cross country skiing boot with the depressions corresponding to the device of FIG. 2.

FIG. 1 shows the boot 3 of a cross country ski 1 which is fixed to the latter by an only partly shown front binding 2. Binding 2 which presses down the front end 4 of the extended sole 5, as well as the three pins 6 located on the ski and which pass through holes 7 in end 4 are known and do not form part of the invention. Despite the narrow holes 7 the said three pins cannot in themselves provide an adequate lateral guidance because with respect to the boot they are located too far forwards. In addition a certain tolerance must be left between the diameter of the holes and that of the pins. Thus, a rigid guidance for taking up lateral forces is not possible.

This can only be brought about by means of the boot for a longitudinal ski in accordance with the present invention. As can be seen more particularly from FIGS. 2 and 3 this device comprises a plate 8 located on the surface of the ski and which has one, two or more ribs 9, as well as depressions 10 in the sole 5 of boot 3 which are matched to said ribs. According to this preferred embodiment the elevations 9 are constructed as two parallel longitudinal ribs with a slight rounding of the upper edges 11 at their two ends, as can be gathered from FIG. 2. The depressions 10, here in the form of longitudinal grooves, are arranged in sole 5 with the same spacing as the longitudinal ribs. The grooves start at front end 4 and terminate at the rear end of sole 5, their depth corresponding approximately to the height of longitudinal ribs 9.

Plate 8 has holes 12 permitting the screwing thereof to ski 1. Advantageously together with longitudinal ribs 9 they form a single component made from plastic which can also be connected to the actual binding 2.

Due both to the relatively long ribs 9 and to the binding 2, which ensures a good engagement of the ribs in depressions 10, a satisfactory lateral guidance of the boot on the ski is ensured without impairing the skiing properties. Obviously locking mechanisms no longer have to be engaged and disengaged. Guidance is still maintained if, as indicated by dotted lines in FIG. 1, the boot is raised from the surface of the ski. During a descent at least the front part of the sole 5 of the boot remains engaged with the ski so that the device is effected over its entire length. Should this prove necessary it could, however, be extended up to the heel of the boot 3.

In principle any form of the elevations and corresponding depressions would be conceivable and in theory even a single elevation and a single depression would fulfill this function. However, the represented embodiment has the advantage that when putting on the skis the longitudinal ribs 9 can also be used to free the longitudinal grooves 10 from tamped snow by effecting a single sliding movement. It is also advantageous to provide the elevations 9 on the ski and depressions 10 in the sole and not the other way round. The sole 5 for boots for long distance skis must be fairly thick so that the provision of the depressions does not weaken the same.

We claim:

1. Cross country skiing boot fitting into a device for the lateral guidance and front fixing thereof on the long distance ski, characterised in that in the boot sole (5) is provided at least one depression or one elevation (10) in the direction of the longitudinal axis of the boot which, with the corresponding elevation or depression (9) in the device, effects the lateral guidance of the boot during cross country skiing and that the depressions or elevations in the sole and the corresponding depressions or elevations in the guidance device extend from the boot fixing device at the front to the end of the front part of the boot sole at the rear, ensuring the engagement of the elevations in the depressions during all foot movements in cross country skiing.

2. Cross country skiing boot according to claim 1, characterised in that it has one, two or more longitudinal grooves (10) in the sole, into which fit the corresponding longitudinal ribs (9) of a plate (8) of the guidance device.

3. Cross country skiing boot according to claims 1 or 2, characterised in that the depressions or elevations are highest on the boot sole at the front and decrease in height towards the end of the front part of the sole.

4. Cross country skiing boot according to claims 1 or 2, characterised in that the depressions or elevations are wedge-shaped and taper upwards or downwards.

5. Method for the manufacture of a cross country skiing boot according to claim 1, characterised in that in the case of depressions in the sole the manufacturing mould has corresponding grooves and in the case of elevations in the sole the mould has corresponding ribs.

* * * * *